US005720055A

United States Patent [19]

Krist

[11] Patent Number: 5,720,055

[45] Date of Patent: Feb. 24, 1998

[54] CLEANING AND HYGIENIC DEVICE

[76] Inventor: Robert Krist, 121 Holy Cross Pl., Kenner, La. 70065-4055

[21] Appl. No.: 551,630

[22] Filed: Nov. 1, 1995

[51] Int. Cl.[6] ..... A47K 3/22; E03C 1/06; E03D 9/08

[52] U.S. Cl. ..... 4/420.4; 4/444; 4/448; 4/666; 4/255.06

[58] Field of Search ..... 4/444, 447, 448, 4/420.1, 420.4, 420.5, 666, 443, 445, 420.2, 420.3, 237, 255.04, 255.06; 239/391, 569

[56] References Cited

U.S. PATENT DOCUMENTS

| | | | |
|---|---|---|---|
| 1,818,388 | 8/1931 | Farley | 4/448 |
| 2,036,985 | 4/1936 | Salvoni | 4/7 |
| 2,751,604 | 6/1956 | Young | 4/237 |
| 3,430,268 | 3/1969 | Zoberg | 4/447 |
| 3,593,349 | 7/1971 | Bungo | 4/237 |
| 3,728,743 | 4/1973 | Hagopian | 4/448 |
| 3,860,971 | 1/1975 | Dirks | 4/666 |
| 4,000,742 | 1/1977 | DiGlacomo | 4/448 |
| 4,205,402 | 6/1980 | Miller | 4/447 |
| 4,287,618 | 9/1981 | Silver | 4/444 |
| 4,326,308 | 4/1982 | Silver | 4/444 |
| 4,510,630 | 4/1985 | Osgood | 4/443 |
| 4,596,058 | 6/1986 | Nourbakhsh | 4/448 |
| 4,622,704 | 11/1986 | Chung | 4/443 |
| 4,764,997 | 8/1988 | Anderson et al. | 4/445 |
| 5,023,961 | 6/1991 | Alonso | 4/443 |
| 5,090,067 | 2/1992 | Cogdill | 4/448 |
| 5,295,274 | 3/1994 | Daniels et al. | 4/448 |
| 5,384,919 | 1/1995 | Smith | 4/448 |
| 5,419,363 | 5/1995 | Robinson | 137/360 |

FOREIGN PATENT DOCUMENTS

| | | | |
|---|---|---|---|
| 2596974 | 10/1987 | France | 4/444 |
| 2266323 | 10/1993 | United Kingdom | 4/420.5 |

*Primary Examiner*—Charles R. Eloshway
*Attorney, Agent, or Firm*—Pravel, Hewitt, Kimball & Krieger

[57] ABSTRACT

A cleaning device which can be used as a personal hygienic unit, as a unit for cleaning a diaper area of an infant, and rinsing soiled diapers, or as a cleaning unit for clearing clogs in a toilet or drain pipe. There is included a flexible hose which is connected to a water supply and to an inlet of a flow control valve. An outlet of the flow control valve is connected to a rigid hollow handle for delivery of water through the handle to a sprayhead secured at an acute angle in relation to a longitudinal axis of the handle so as to deliver water upwardly from the spray head openings when the device is in use. A secondary unit is independently connected to a water supply for delivery of water to a hand-held spray nozzle to allow cleaning of a diaper area of an infant and rinsing soiled diapers. As an alternative to the sprayhead, there is provided a flexible, bendable pipe having a free open end, through which a stream of water can be delivered to an immediate proximity of a clogged toilet or drain.

22 Claims, 2 Drawing Sheets

CLEANING AND HYGIENIC DEVICE

BACKGROUND OF THE INVENTION

This invention relates to cleaning devices, and, more particularly, to an attachment for water closets which can be used as a bidet, as a cleansing device for babies, their soiled diapers, and a device for clearing clogged toilets and drains.

The advantages of bidet bathroom fixtures and sitz baths are well recognized in the art of therapeutic hygienic cleaning. Generally, bidet fixtures are mounted separately from toilet bathroom fixtures and require separate plumbing for proper operation. The disadvantage of such a separate fixture is that it necessarily occupies a space in an often limited confines of a modern bathroom and, in many cases, becomes cost prohibitive. To solve the problem, numerous patents have been issued for attachments for water closets which could serve as bidet, or personal cleaning devices, or which can be doubled as a sitz bath, when necessary. Examples of such attachments can be found in a number of U.S. patents, some of which are listed below:

U.S. Pat Nos. 1,818,388; 2,036,985; 4,000,742; 4,287,618; 4,326,308; 4,510,630; 4,596,058; 4,622,704; 4,764,997; 5,023,961; 5,295,274; 5,384,919; 5,419,363.

Some of these devices disclose the use of hand-held showerheads mounted on a handle which also carries an actuating control valve. Others suggest the use of a showerhead with a rigid handle which is connected to a conventional faucet to allow delivery of water to the showerhead and facilitate personal cleansing of a person seated on a toilet. Still others suggest the use of specially adapted toilet seats to accommodate a showerhead with a nozzle that is supported under the toilet seat to direct the water upwardly. However, none of the above mentioned devices provides for the use of a hygienic device that can be also used to facilitate clearing of drainage clogs or a device that can be used during diaper changes of a baby.

SUMMARY OF THE INVENTION

It is, therefore, an object of the present invention to provide a personal hygienic device which can be connected to conventional water plumbing fixtures and utilized for cleansing of an infant.

It is another object of the present invention to provide a device which can be used for clearing drain clogs in a toilet or in bathroom drains.

It is a further object of the present invention to provide a hand-held personal hygienic device which can be easily connected to commercial bathroom fixtures without requiring expensive separately standing structures.

These and other objects of the present invention are achieved through a provision of a cleaning device which comprises an elongated flexible tubing, one end of which is adapted for connection to a source of water supply. A fluid control valve is secured to one end of the tubing to regulate the flow of water through the tubing. A rigid hollow handle is secured to an outlet of the flow control valve, the handle carrying a vented spray nozzle at its free end, with the spray nozzle provided with a plurality of openings. A curved connecting member retains the spray nozzle at an acute angle in relationship to a longitudinal axis of the handle so as to direct a flow of water exiting through the openings upwardly when the cleaning device is in use.

The handle is long enough to extend from an outside confines of a toilet bowl to a location immediately above the toilet bowl. When the device is in use, the control valve appears on the outside of the toilet bowl, in front of the user seated on the toilet bowl.

An open front or optional modified toilet seat is provided with a curved cutout in its top upper surface to accommodate the handle which rests in the cutout or opening when the device is in use. A sealing gasket is secured to the underside of the toilet seat to seal the parameter of the toilet seat and close the area between the top rim of the toilet bowl and the underside of the toilet seat, thereby preventing escape of water from the toilet bowl.

An alternative embodiment of the cleaning device in accordance with the present invention provides for the use of a cleaning attachment suitable for clearing clogged drain outlets. This attachment unit comprises a length of flexible tubing made from for example plastic or rubber so as to bring an open free end of the tubing to an immediate proximity of the clogged opening and deliver a stream of water through the drain outlet to thereby facilitate clearing of the toilet or drain pipe.

A further alternative embodiment of the cleaning device in accordance with the present invention provides for the use of a secondary cleaning unit suitable for cleaning a diaper area of an infant. The secondary unit provides for the use of an elongated hose independently connected to a source of water supply and provided with a spray nozzle on the free end of the hose. A spring operated manual depressible lever regulates the flow of water exiting the openings in the sprayer to clean the infant and rinse the soiled diaper.

An optional open top housing in the form of a basket with openings or slots is provided for use with the secondary unit. The housing, or basket, is dimensioned to be seated over the toilet bowl and engage with its rim the inside parameter of the toilet seat or the top rim of a toilet bowl. The user positions an infant into the basket and, while holding the infant with one hand, directs the spray of water through the hand-held sprayhead onto the diaper area and afterward onto the diaper which is rinsed in the basket.

The cleaning device in accordance with the present invention provides and inexpensive, versatile alternative to cumbersome bathroom fixtures currently known in the industry.

BRIEF DESCRIPTION OF THE DRAWINGS

Reference will now be made to the drawings, wherein like parts are designated by like numerals and wherein.

DETAILED DESCRIPTION OF THE PREFERRED EMBODIMENT

Figure 4:
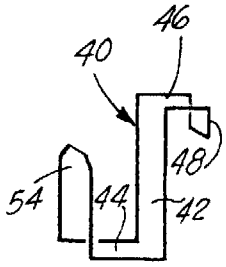
FIG. 4 is a detail view of a support bracket suitable for mounting the device on a water closet tank

Referring now to the drawings in more detail, numeral 10 designates the cleaning device in accordance with the present invention. The device 10 comprises a hand-held personal hygiene attachment unit 12 which is connected to a dual outlet water supply valve 14 by a flexible elongated tubing 16. The tubing 16 can be made from plastic or spiral metal hose. The tubing 16 is made from a heat transferable material, such as metal. It is preferred that a collar 17 is placed over at least a portion of the tubing 16 so as to minimize discomfort of contact with cold metal part by the body of the user. The collar 17 is shown schematically in FIGS. 1, 5, and 8. The unit 12 is comprised of an elongated tubular rigid hollow handle 18 having an inlet portion, connected to an outlet 20 of a control valve 22, and an outlet portion, provided with a standard annular fitting connector 24. Detachably connected to the fitting 24 is a shower sprayhead 26 which is secured to the fitting 24 by a curved elbow joint 28 which allows to retain the shower sprayhead 26 at an acute angle in relationship to a longitudinal axis of the handle 18.

Mounted in a surrounding relationship over at least a part of the handle 18 is a grip portion 30 made from a resilient flexible material, for example rubber, to facilitate convenient frictional engagement of the handle by the user.

Figure 1:
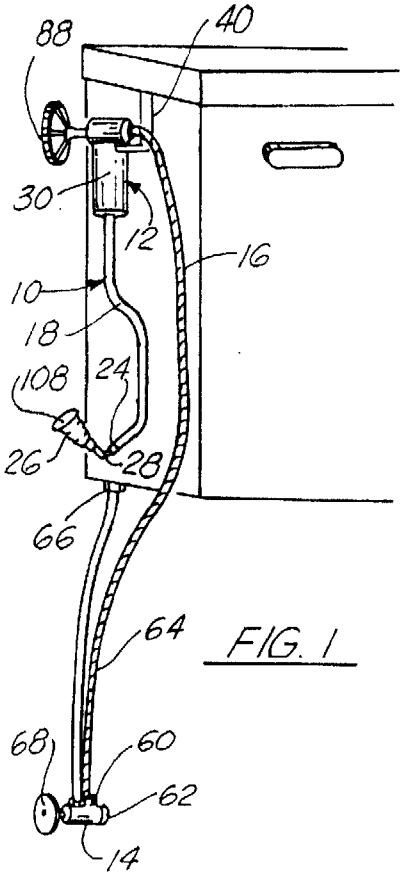
FIG. 1 is a perspective view of the device in accordance with the present invention mounted a tank of a water closet.
Figure 9:
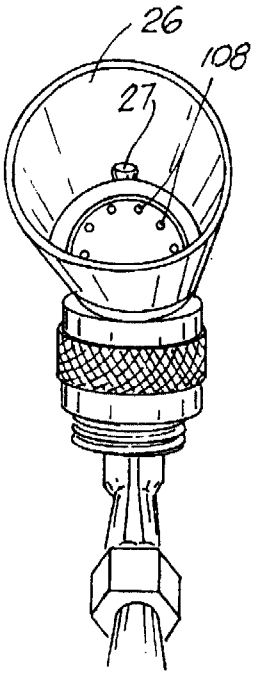
FIG. 9 is a perspective detailed view of the shower sprayhead for use in the present invention.
Figure 6:
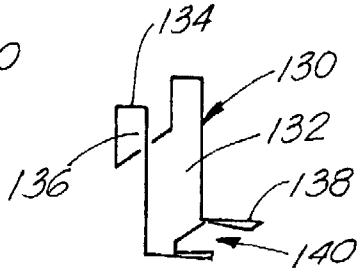
FIG. 6 is a detail view showing a support bracket for the sprayhead suitable for use during diaper changes.

As can be seen in FIGS. 1 and 4, the valve body 32 of the control valve 22 is removably supported on a J-shaped bracket 40 which is comprised of an elongated narrow plate 42 provided with transverse extensions 44 and 46. Extension 46 is unitarily attached to the upper end of the plate 42, while the extension 44 is unitarily attached to the lower end of the plate 42. The length of the extension 46 is slightly greater than the thickness of a conventional toilet tank wall to allow positioning of the extension 46 on the top edge of the toilet tank, such that the underside of the extension 46 contacts the upper edge of the tank wall.

A downwardly extending lip 48 is oriented at a right angle to the extension 46 and descends inside the toilet tank 50 to prevent disengagement of the bracket 40 from the tank 50. The length of the extension 44 is sufficient to support a bottom wall 52 of the flow control valve 22 when the unit 12 is positioned in the bracket 40. Securely connected to the extension 44 is a second vertical plate 54 which is oriented in a substantially parallel relationship to the first vertical plate 42 and prevents sliding of the unit 12 from the extension 44 when the unit 12 is supported by the bracket 40.

In such cases where the toilet tank has a flushing handle on a side of at toilet tank, it is preferred that the bracket 40 be mounted on a wall adjacent the toilet tank so as not to interfere with the normal operation of the lavatory. In that case, it is possible to have extension 46 rest on some outwardly projecting member associated with the wall mount and be disengageable therefrom when required.

As can be further seen in FIG. 1, the conventional dual outlet water supply valve 14 is provided with a second outlet 60 which receives a water flow from the inlet end 62 of the valve 14. A flexible tubing 64 is connected to the outlet 60 at one of its ends and to an inlet 66 of the toilet tank 50. A control handle 68 allows to control the water flow from a municipal water supply through the valve 14 to the device 10 and to the toilet tank 50.

Figure 2:
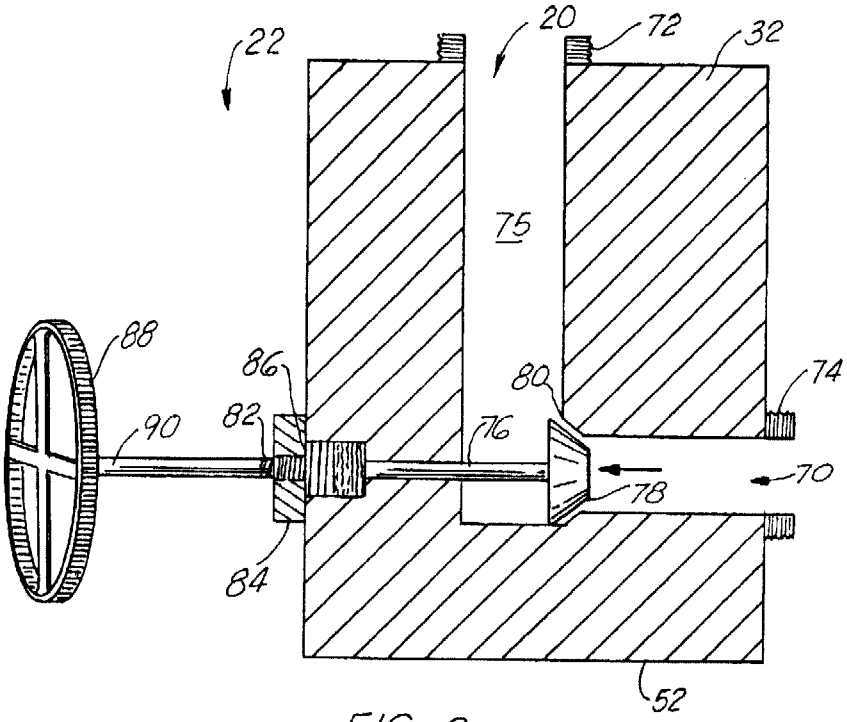
FIG. 2 is a perspective, partially cross sectional view of a flow control valve of the device in accordance with the present invention.

Turning now to FIG. 2, the flow control valve 22 in accordance with the present invention is shown to comprise the valve body 32 provided with an outlet orifice 20 and an inlet orifice 70. Both the inlet and outlet orifices are provided with conventional externally threaded annular connectors 72 and 74, respectively, to allow connection of matchingly threaded tubing connectors to the inlet and outlet of the valve 22. Of course the connectors 72 and 74 can be made as female members or a combination of one male and one female member. An internal conduit 75 is formed inside the body 32 in fluid communication between the inlet orifice 70 and the outlet orifice 20. The conduit 75 is formed as an L-shaped channel within which a shaft 76 moves in a sliding reciprocating relationship.

A plug 78 is carried by one end of the shaft 76. The plug 78 is shaped and sized to seat against a conical seat 80 within the conduit 75 and block the passageway connecting the inlet 70 and the outlet 20. The plug 78 is formed with matchingly tapered exterior wall to snugly fit against the seat 80 and terminate the fluid flow from the inlet 70 to the outlet 20 when the valve is closed.

The sliding shaft 76 is threadably engaged, such as by threads 82, within an internally threaded annular bushing 84 which is carried by the valve body 32. The shaft 76 extends through an opening 86 formed in the side of the valve body 32 opposite the inlet orifice 70. A handle 88 is carried by a free end 90 of the shaft 76, the handle 88 allowing to regulate the amount of flow traveling from the inlet 70 to the outlet 20. As the handle 88 is secured in close proximity to the handle 18 of the unit 12, the user can conveniently regulate the flow of water traveling through the spray nozzle 26 during operation of the device 10.

If desired, the spray nozzle head 26 can be provided with a suitable vent 27, as well as a keyed fitting to prevent the elbow joint 28 from turning out of its set position during operation of the device.

Figure 3:
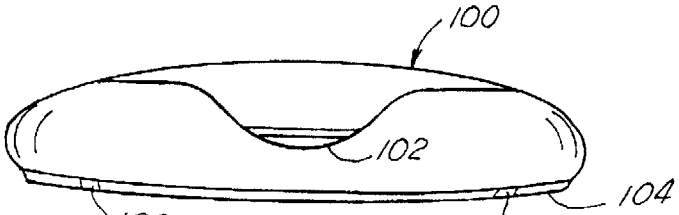
FIG. 3 is a front view of a modified toilet seat designed to accommodate a hand-held spray nozzle of the device in accordance with the present invention.

Turning now to FIG. 3, the modified toilet seat to be used with the cleaning device 10 is illustrated. The toilet seat 100 is provided with an indentation 102 in its front top surface to accommodate the handle 18 when it is positioned above the toilet bowl (not shown) before operation of the device. A peripheral gasket 104 is secured about the periphery of the underside of the seat 100 to close the gap between the seat 100 and the top rim of a toilet bowl. One or more air vents 106 are formed in the gasket 104 as can be better seen in FIG. 3. The gasket 104 can be made from a flexible resilient material, such as plastic or rubber, and can be glued to the bottom of an existing toilet seat or manufactured as part of a modified toilet seat shown in FIG. 3. The gasket 104 prevents water from escaping the confines of the toilet bowl during operation of the device.

During use, the device 10 is removed from its position on the bracket 40 and the handle 18 is inserted in the indentation 102 on the seat 100 of a toilet bowl. The spray head 26 is oriented with its opening 108 in such a manner that the water flow is directed upwardly when the control valve 22 is in an open position. Since the control valve 22 will extend directly in front of the user when he or she is seated on the toilet seat 100, the regulation of the flow of water can be easily accomplished. The unit 12 will serve as a personal hygienic cleaning device or as a bidet for the user when the spray nozzle attachment 26 is engaged with the handle 18.

Figure 5:
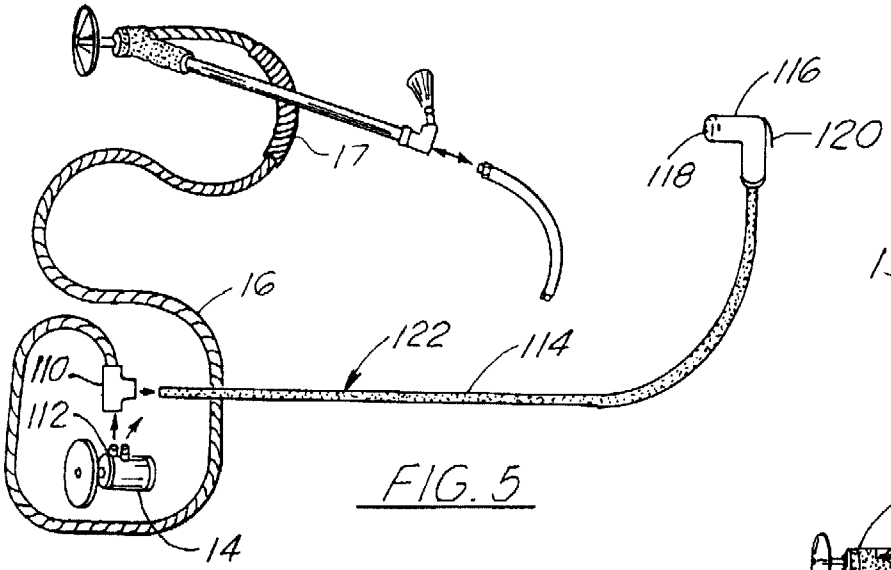
FIG. 5 is an alternative embodiment of the hygienic device in accordance with the present invention provided with a sprayhead nozzle suitable for use during diaper changes.
Figure 7:
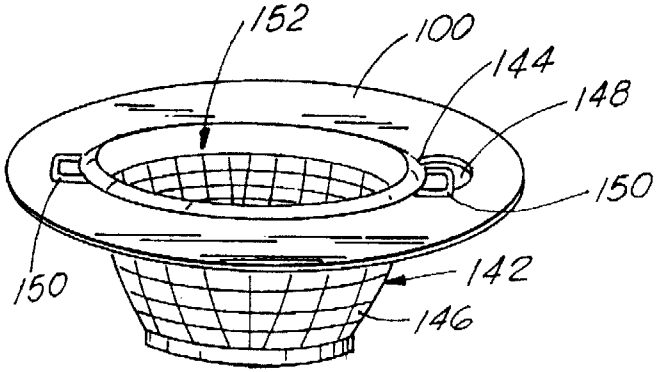
FIG. 7 is a perspective view of a basket suitable for accommodating an infant during a diaper change.

When it becomes necessary to use the cleaning device 10 for cleansing a baby during a diaper change, the device 10 provides for the use of an alternative embodiment shown in FIG. 5. In this embodiment, a T-connector 110 is secured to one of the outlets 112 of the outlet valve 14. The connector 110 connects a second flexible hose 114 to the outlet 112, while another tubing 16 is connected to its second outlet. The remaining open outlet allows connection of a hose to supply water to the toilet tank. The hose 114 carries a hand-held sprayhead, or attachment 116 which is comprised of an elbow-shaped sprayhead formed with a plurality of spray openings 118 formed in one end of the sprayhead 116. A spring operated lever 120 is carried by the sprayhead 116 to allow for precise regulation of the amount of water delivered through the openings 118 when the attachment 116 is in use.

A separate bracket 130 is provided for supporting the attachment 116 on the toilet tank 50. The bracket 130, similar to the bracket 40, is comprised of an elongated narrow plate 132 having a transverse extension 134 which is designed to rest on the top rim of the toilet tank 50. A downwardly extending plate 136 prevents disengagement of the bracket 130 from the tank 50. A second horizontal extension 138 is provided with an irregularly-shaped opening 140 which is designed to accommodate the sprayhead 116 and retain it in a secure position within the bracket 130 when the unit 116 is not in use.

In order to safely hold the infant above the toilet bowl, the present invention contemplates provision of an optional infant basket 142 which has an upper rim 144 extending transversely to the body 146 of the basket 142. The rim 144 is of a diameter greater than the opening 148 in the toilet seat 100 so as to allow retention of the basket 142 above the toilet bowl when an infant is placed in the basket 142. A pair of handles 150 are secured on opposite sides of the basket body 146 to facilitate positioning and removal of the basket 142, when in use.

In operation, the user places the baby into the chamber 152 which is defined by the interior wall of the basket body 146. It is preferred that the body 146 be formed with slots or openings to allow escape of water and debris from the interior chamber 152 during use of the basket 142. Holding the infant with one hand, the user picks up the unit 122 from the bracket 130. While holding the sprayhead 116, the user pushes on the lever 120 to allow water to escape through the openings 118 and cleanse the diaper area of the infant. After the infant has been attended to, the soiled diaper and the basket 152 can be rinsed of debris using the unit 122.

Figure 8:
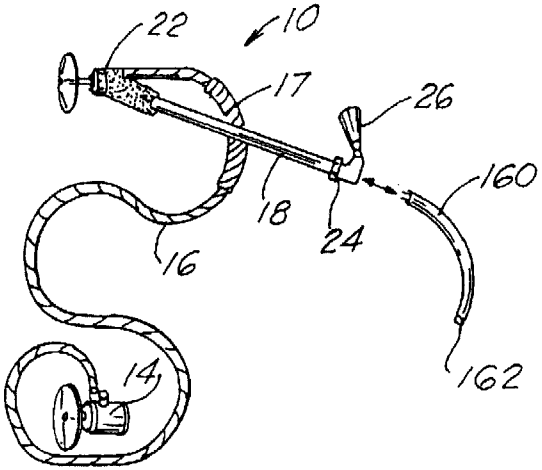
FIG. 8 is a perspective view of a third embodiment of the device in accordance with the present invention utilizing an attachment for clearing drainage clogs.

Turning now to FIG. 8, the third embodiment of the device in accordance with the present invention is illustrated. The third embodiment provides for the use of a detachable, flexible extension tubing 160 which can be secured to the attachment ring 24 at one of its ends as a substitute for the spray nozzle assembly 26. The tubing 160 has an open free end 162 which delivers a flow of water from the handle 18 when the valve 22 is in an open position. It is preferred that the tubing 160 be made from a flexible, bendable material to allow directing of a water flow in a narrow, strong flow to a drain opening of a sink, toilet, bathtub, or shower. The flow of water, being directed to the immediate proximity of the drain opening facilitates breaking of the debris accumulated in that area and clearing of the drainage opening.

It is envisioned that the hose 16 can be manufactured as a spiral hose, and that other flexible tubing can be made from a similar material so as to minimize clutter in the limited confines of a modem bathroom. The cleaning device 10 can be easily connected/disconnected either by hand or by using standard plumbing instruments, and can be sold as a unit with different attachments, or with one attachment, as desired.

The length and shape of the handle 18 can be easily modified either by the manufacturer or the user to accommodate requirements of the user.

Many changes and modifications can be made in the design of the present invention without departing from the spirit thereof. I, therefore, pray that my rights to the present invention be limited only by the scope of the appended claims.

I claim:

1. A cleaning device, for use with a personal hygiene toiletry fixture, and a source of fresh water supplied to the toiletry fixture through a valving element, the cleaning device comprising:

an elongated flexible tubing having two ends, one end of the tubing adapted for connection to the valving element through which the source of water is supplied to the toiletry fixture;

a rigid hollow handle mounted in fluid communication with a second end of said tubing;

a flow control valve mounted between said second end of said tubing and said handle for regulating a flow of water from said source of water through said handle; and a cleaning attachment detachably securable to a free end of said handle for receiving the flow of water through said handle and emitting a flow of water from said cleaning attachment;

a support stand for supporting said cleaning device on a vertical structure, said support stand further comprising a bracket shaped to retain said handle in vertical suspension and provided with a unitary extension adapted for resting on a top rim of the toilet fixture.

2. The device of claim 1, wherein said cleaning attachment comprises a sprayhead with a plurality of openings carried by a curved connecting member, said connecting member retaining said sprayhead to said handle so as to direct a flow of water exiting through said opening upwardly when the cleaning device is in use.

3. The device of claim 1, wherein said cleaning attachment comprises a flexible elongated pipe having an open free end for delivering a stream of water to a clogged drain opening to thereby facilitate clearing of the drain opening.

4. The device of claim 1, further comprising a secondary cleaning unit adapted for connection to the source of water supplied to the toiletry fixture independently from said flexible tubing.

5. The device of claim 4, wherein said secondary cleaning unit comprises a flexible hose carrying a hand-held spray nozzle, said spray nozzle being provided with a spring-operated control lever for regulating a flow of water through said spray nozzle.

6. The device of claim 5, wherein said secondary unit further comprises an open top housing adapted for positioning over a toilet seat and sized to accommodate an infant being cleaned with water delivered through said spray nozzle.

7. The device of claim 5, further comprising a means for supporting the secondary unit on a vertical structure.

8. The device of claim 7, wherein said means for supporting the secondary unit comprises a bracket adapted for suspending from a top rim of a toilet tank, said bracket being provided with a cutout sized and shaped to retain at least said spray nozzle in a frictional engagement with said bracket.

9. The device of claim 1, wherein said handle is provided with a friction collar to facilitate gripping of the handle by a user.

10. The device of claim 1, wherein said bracket further comprises a I-shaped bracket.

11. The device of claim 1, further comprising a means for sealing a perimeter of a toilet seat mounted on the toiletry fixture to prevent escape of water between the toilet seat and a bowl portion of the toiletry fixture.

12. The device of claim 11, wherein said sealing means comprises a flexible resilient gasket securely engageable with a bottom surface of the toilet seat, said gasket having a sufficient width to contact a top rim of the toilet bowl when engaged with said toilet seat.

13. The device of claim 1, wherein said handle has a discrete length sufficient for extending said handle from an outside of a toilet seat to a distance above a toilet bowl.

14. The device of claim 13, wherein there is provided a curved cutout in the front upper surface of said toilet seat to allow said handle to be inserted within said cutout when the cleaning device is in use.

15. A cleaning device, for use with a toilet of the type having a tank portion and a bowl portion, and a source of fresh water supplied to the tank portion through a valving element, the cleaning device comprising:

an elongated flexible tubing adapted for connection at a first end to the source of fresh water supplied to the tank portion through the valving element;

a rigid hollow handle mounted at a second end of said flexible tubing in fluid communication with said tubing, said handle having a discrete length sufficient for extending said handle from a point outside of a toilet seat to a distance above a toilet bowl when the cleaning device is in use;

a flow control valve mounted between said tubing and said handle for regulating a flow of water through said handle, said control valve being located in front of the toilet bowl when the cleaning device is in use;

a cleaning attachment detachably securable to a free end of said handle, said cleaning attachment comprising a spray head with a plurality of openings, said spray head carried by a curved connecting member, said connecting member retaining said spray head to said handle so as to direct a flow of water exiting through said openings upwardly when the cleaning device is in use;

a secondary cleaning unit adapted for connection to the source of fresh water supplied to the tank portion through the valving element, said secondary cleaning unit comprising a flexible hose carrying a hand-held spray nozzle, said spray nozzle being provided with a depressible control lever for regulating a flow of water through the spray nozzle; and means for supporting said cleaning device and said secondary cleaning unit independently on a vertical structure, said means further comprising a pair of brackets, each of said brackets having a unitary extension adapted for positioning over a top rim of a toilet tank to allow suspension of the brackets on said toilet tank.

16. The device of claim 15, wherein said secondary unit further comprises an open top housing adapted for positioning over a toilet seat and sized to accommodate an infant's diaper being cleaned with water delivered through said spray nozzle.

17. The device of claim 10, wherein there is provided a curved cutout in the front upper surface of said toilet seat to allow said handle to rest within said cutout when the cleaning device is in use.

18. The device of claim 10, further comprising a means for sealing a periphery of the toilet seat to prevent escape of water between the toilet seat and the toilet bowl, said sealing means comprising a flexible resilient peripheral gasket securely engageable with a bottom surface of the toilet seat, said gasket having a sufficient width to contact a top rim of the toilet bowl when engaged with said toilet seat.

19. The device of claim 10, wherein said handle is provided with a friction collar to facilitate gripping of the handle by a user.

20. A cleaning system comprising:

a toilet fixture, having at least a bowl portion;

a source of fresh water supplied to the toilet fixture;

a valving element regulating the flow of fresh water to the toilet fixture;

an elongated flexible tubing having a first end adapted for connection to said valving element;

a rigid hollow handle mounted in fluid communication with said tubing at a second end of the tubing;

a flow control valve mounted between said tubing and said handle for regulating a flow of fresh water through said handle while allowing fresh water to continue to flow to said toilet fixture;

a cleaning attachment detachably securable to a free end of said handle, said cleaning attachment comprising a flexible elongated pipe having an open free end for delivering a stream of water to an item to be cleaned; and a support stand for supporting said cleaning device on a vertical structure, said support stand further comprising a bracket and shaped to retain said handle in vertical suspension and provided with a unitary extension adapted for resting on a top rim of said toilet fixture.

21. The system in claim 20, wherein said bracket comprises a J-shaped bracket provided with a unitary extension adapted for resting on a top rim of the toilet fixture.

22. The cleaning system in claim 20 wherein said toilet fixture further comprises a tank portion.

* * * * *